United States Patent [19]

Swango

[11] 3,968,608

[45] July 13, 1976

[54] CURTAIN WALL PANEL SUPPORT

[76] Inventor: Billy J. Swango, 4141 N. St. Augustine, Dallas, Tex. 75227

[22] Filed: Aug. 12, 1974

[21] Appl. No.: 496,646

[52] U.S. Cl. ..... 52/235; 52/127; 52/398; 52/403

[51] Int. Cl.[2] ..... E04B 1/66; E06B 3/62

[58] Field of Search ..... 52/235, 397, 400, 403, 52/483, 489, 495, 393, 398, 399

[56] References Cited

UNITED STATES PATENTS

| | | | |
|---|---|---|---|
| 3,092,877 | 6/1963 | Perilstein | 52/403 X |
| 3,230,677 | 1/1966 | Brown | 52/400 X |
| 3,316,681 | 5/1967 | Eber | 52/235 |
| 3,435,579 | 4/1969 | Horgan | 52/400 |
| 3,699,735 | 10/1972 | Smith | 52/400 |
| 3,734,550 | 5/1973 | Vance | 52/397 X |
| 3,766,698 | 10/1973 | Dallen | 52/400 |
| 3,866,374 | 2/1975 | Dallen | 52/400 |

FOREIGN PATENTS OR APPLICATIONS

| | | | |
|---|---|---|---|
| 1,011,881 | 12/1965 | United Kingdom | 52/461 |

*Primary Examiner*—Ernest R. Purser
*Assistant Examiner*—William Randolph
*Attorney, Agent, or Firm*—Howard E. Moore; Gerald G. Crutsinger

[57] ABSTRACT

A support member for connecting panels of a curtain wall to horizontal mullions. Each mullion has a channel formed therein and has shoulders at opposite sides of the channel. The panel support member comprises a rigid bar, positioned in the channel in the mullion, and a tenon extending longitudinally of the bar. Anchor lugs extend outwardly from opposite sides of the tenon. A gasket, having panel receiving slots formed therein, has a groove extending longitudinally thereof to receive the tenon and anchor lugs. As anchor bolts are tightened, drawing the bar into the channel in the mullion, external abutments on the gasket are drawn into the channel such that a portion of the gasket is captured between the shoulders and the lugs to resist deformation of the gasket relative to the load carrying tenon.

5 Claims, 3 Drawing Figures

CURTAIN WALL PANEL SUPPORT

BACKGROUND OF THE INVENTION

A curtain wall is an exterior building wall which carries no roof or floor loads. Principal elements of a curtain wall are wall panels, constructed of glass, metal, concrete, or a combination of several materials forming a composite fabrication into a single wall panel assembly. The wall panels are generally secured between horizontally and vertically extending mullions which are fastened to beams and columns of load bearing members arranged to form the structural frame of a building.

Curtain wall panel units and assemblies are generally prefabricated and manufactured to closely predictable sizes; however, beams and columns of the structural elements of the building to which the panel must be secured are much less precisely located at the erection site. Therefore, support members for connecting panels of the curtain wall to structural elements of the building must exhibit three predominating basic characteristics: load carrying capability to support the wall panel without substantial deformation, adjustability to facilitate attachment of panels to structural members, and sealing qualities to minimize infiltration of wind, rain, snow, hail, and the like.

Support members heretofore devised have not effectively incorporated the above predominating characteristics into a structure which could be rapidly assembled at the erection site for attachment of wall panels to form an enclosing envelope about the structural frame of the building.

Support structure heretofore devised has relied upon the internal strength of resilient gaskets having generally H-shaped cross-section, as described in U.S. Pat. No. 3,699,735, for providing structural strength for supporting the weight of wall panels as well as providing sealing capability. Variations of such H-shaped gaskets which employ filler strips of wedges insertable in grooves extending longitudinally of the seal member are illustrated in U.S. Pat. No. 2,655,239 and U.S. Pat. No. 3,138,229.

Resilient gaskets having slots formed in opposite sides thereof function effectively for providing seals along vertically disposed edges of panels and between horizontally disposed edges of panels and surfaces of mullions in specific installations wherein the mullion and panel lie in a common plane. However in installations in which a mullion, extending along the lower edge of the wall panel, is to support wall panels lying in a plane outwardly of the mullion, metallic structural members are generally attached to the outside of the resilient gasket and secured therethrough by bolts installed from exteriorly of the building, for example as disclosed in U.S. Pat. No. 3,766,698 and 3,488,906. Thus, the erection of appropriate scaffolding has been required heretofore for adjustment of support members attaching lower edges of panels to horizontally disposed mullions in instances wherein the wall panel and mullion lie in different vertical planes.

In addition to time consumed in installation of gaskets having metallic support members exposed to the exterior of the building, thermal insulating qualities of such support members is substantially less than that of support members having only non-metallic material exposed exteriorly of the building wall. It should also be noted that the metallic members exposed to the exterior of the building present corrosion and sealing problems and consequently more expensive maintenance than is required in installations wherein panel support members have only non-corrosive, non-conductive outer surfaces.

SUMMARY OF INVENTION

The improved curtain wall gasket support member comprises a rigid support bar connectable to a horizontal mullion and having an outwardly extending tenon formed thereon extending along the length thereof. The outer end of the tenon is positioned in a groove formed in a resilient gasket such that the weight of a wall panel is distributed along the length of tenon whereby internal strength of the resilient gasket is not relied upon to support the weight of the wall panel.

The tenon preferably has anchor lugs extending outwardly from opposite sides thereof which are embedded in the resilient gasket. The gasket is deformable to facilitate positioning the tenon and anchor lugs in a groove extending along the gasket. However, the gasket has abuttments extending along upper and lower edges thereof which are received in a groove formed in the mullion such that tightening of anchor bolts, which secure the support bar to mullions, will draw the abuttments on the resilient gasket into engagement with shoulders formed in the groove in the mullion. Engagement of the abuttments on the gasket with shoulders in the groove in the mullion restrains the gasket against deformation by horizontally imposed forces transmitted thereto by the wall panels, for example as a result of wind loading on the panel.

A primary object of the invention is to provide a support member for gaskets employed for sealing about edges of wall panels in a curtain wall wherein the support member is rigid and has an outward extending tenon positionable in a groove in a resilient gasket such that force required to support a wall panel will be exerted by a tenon through the resilient gasket and uniformly distributed along the edge of the wall panel.

A further object of the invention is to provide a support member for gaskets positioned about the periphery of a wall panel in a curtain wall wherein a support member is adjustably secured to mullions wherein adjustment is accomplished from the interior of the building.

Another object of the invention is to provide a support member for gaskets positioned about panels of a curtain wall wherein the gasket is structurally reinforced by rigid members positioned to carry vertical loading to support wall panels, outer edges of the reinforcing members being embedded in the gasket, providing a corrosion resistent and thermally insulated surface between the reinforcing member and the exterior of the building.

A still further object of the invention is to provide a support member for gaskets positioned about wall panels in a curtain wall wherein the support member is connectable to mullions from the inside of the building to minimize labor required for the erection of wall panels.

Other and further objects of the invention will become apparent upon referring to the detailed description hereinafter following and to the drawings annexed hereto.

DESCRIPTIONS OF THE DRAWINGS

Drawings of a preferred embodiment of the invention are annexed hereto so that the invention may be better and more fully understood, in which.

Numeral references are employed to designate parts in the drawings and like numerals indicate like parts throughout the various figures of the drawing.

PREFERRED EMBODIMENT

Figure 1:
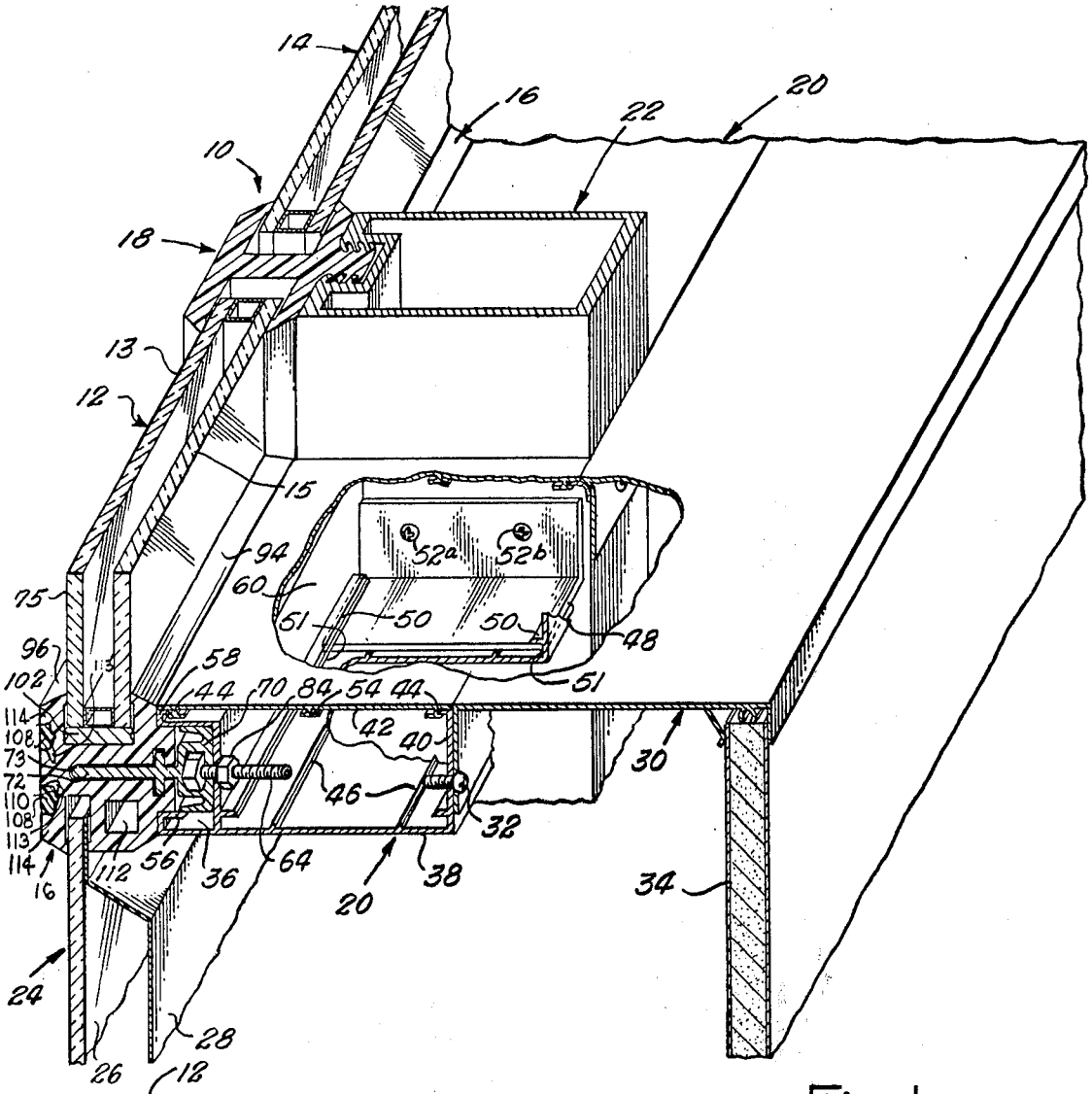
FIG. 1 is fragmentary perspective view of the gasket support member attached to a horizontal mullion, parts being broken away to more clearly illustrate details of construction.

Referring to FIG. 1 of the drawing, the numeral 10 generally designates a curtain wall comprising wall panels 12 and 14 having edges extending into horizontally and vertically disposed gaskets 16 and 18 which are secured to horizontal and vertical mullions 20 and 22 respectively.

Wall panel 12 and 14 are of conventional design and may assume any desired configuration and may be constructed of any suitable material. Wall panels 12 and 14 illustrated in the drawing comprise spaced rectangular sheets 13 and 15 of glass.

The vertically disposed mullions 22 are of conventional design and preferably extend through one or more stories of a building and a mullion section is connected by a slip-joint (not shown) to the end of an additional vertically disposed mullion section positioned above or below mullion 22 such that the mullions extend for example from a base slab to the roof of a building. While only one vertically disposed mullion 22 is illustrated in the drawing, it should be appreciated that a plurality of such mullions will generally be employed to support vertically disposed edges of each of a plurality of wall panels to form a curtain wall. Such construction wherein a plurality of horizontally and vertically spaced mullions are employed to form a wall from a plurality of wall panels is believed to be within the skill of persons skilled in the art and further discussion thereof is not deemed necessary. However, for purposes of illustration reference is made to FIG. 1 of U.S. Pat. No. 3,488,906, for illustration of the general exterior configuration of typical curtain wall.

If it is deemed expedient to do so, spandrel panels 24 may be employed to extend horizontally and/or vertically along the exterior of the building between panels 12 and 14 to form an opaque panel such that building structure located behind the panel is not visible from the exterior of the building. The spandrel panel 24 may be constructed of a sheet of glass 26 having a reflective metal backing 28 positioned therebehind. In addition, a shelf 30 may be secured to horizontal mullion 20 by screws 32 having a bracket to which wall board 34 is connected so as to form a utility area between the spandrel panels 24 and the wall board 34.

Horizontal mullion 20 is generally of a rectangular shape having a channel 36 at one edge of the mullion 20, a bottom 38, a side 40, and a top 42 which is disengageably secured to channel 36 and side 40 by lugs 44. Bottom 38 has beads 46 formed therein to stiffen the bottom 38 and prevent warping and to engage angle 48. Angle 48 is slidably disposed in channels 51 formed by shoulders 50 to support horizontal mullion 20. Angle 48 is secured to vertical mullion 22 by screws **52*a* and 52*b*. Top 42 has a stiffener 54 longitudinally disposed thereof to prevent warping and buckling of top 42**.

Figure 2:
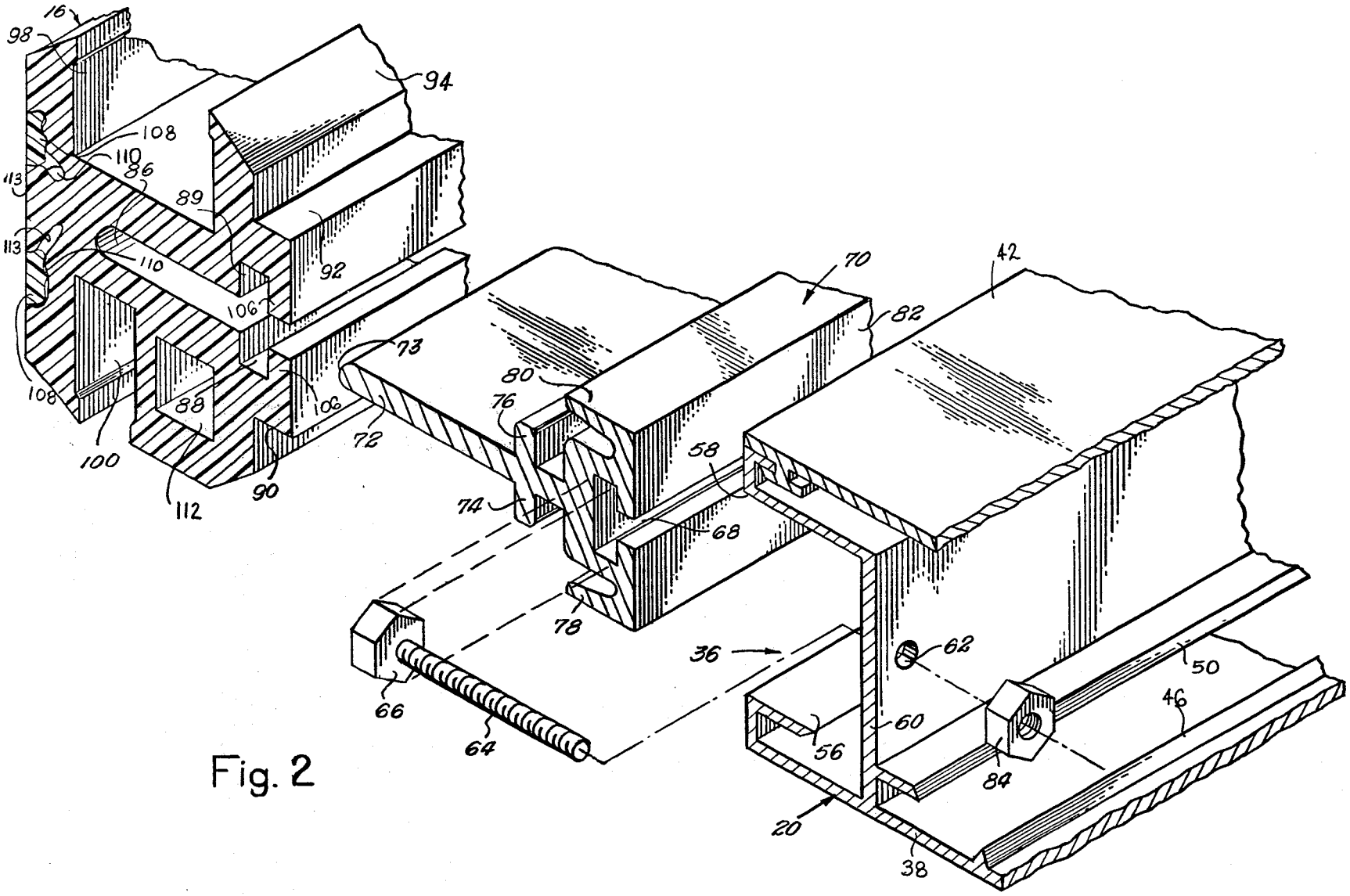
FIG. 2 is an exploded perspective view of the support member, a mullion and a gasket.

As best illustrated in FIG. 2 of the drawing, channel 36 has internal shoulders 56 and 58 formed on opposite ends of web 60. Passages 62 are formed in web 60 to accept stud 64. Means to attach said support bar 70 to channel 36 such as stud 64 has a head 66 formed on one end thereof which engages a T-shaped groove 68 longitudinally formed in support bar 70 to secure same to channel 36 of horizontal mullion 20.

Support bar 70 is an elongated bar longitudinally disposed in channel 36 and comprises a tenon 72 which extends horizontally so that the edge 73 of tenon 72 extends directly beneath the outer surface 75 of glass sheet 13 of panel 12. Anchor lugs 74 and 76 are formed on opposite sides of tenon 72 such that they are aligned with internal shoulders 56 and 58 when the support bar 70 is drawn into channel 36. External shoulders 78 and 80 are formed on head 82 of support bar 70 so as to engage internal shoulders 56 and 58 of channel 36 when support bar 70 is drawn thereinto. Stud 64 is secured to web 60 of horizontal mullion 20 by nut 84 threaded thereon.

Gasket 16 has a groove 86, having notches 88 and 89 formed therein, to accept tenon 72 and anchor lugs 74 and 76. Gasket 16 may be deflected so that tenon 72 of support bar 70 may be fitted into groove 86 and notches 88 and 89 fit over anchor lugs 74 and 76. for locking the gasket 16 thereinto such that lateral forces cannot withdraw the gasket 16 due to the restraining forces of anchor lugs 74 and 76.

Gasket 16 has sloping edges 94 and 96 formed on the upper edges thereof so as to deflect water and dirt away from slots 98 to prevent leakage.

Channels or slots 98 and 100 are formed in the upper and lower edges of the gasket 16 to receive building panels 12 and 24, forming a seal about the interior and exterior surfaces of panels 12 and 24, sealing the panels from exterior elements.

A rigid pad 102 is placed beneath the building panel 12 to provide uniform loading on gasket 16 and to prevent any rough edges of panel 12 from cutting gasket 16 or creating heavier loads from high points on gasket 16. Gasket 16 is made of resilient material such as neopreme and provides a cushion between panel 12 and tenon 72.

Figure 3:
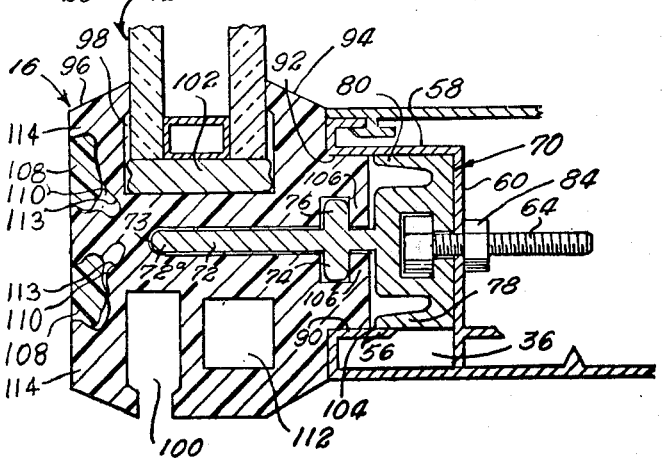
FIG. 3 is an enlarged cross-sectional view of the gasket and support members.

It should be noted from FIG. 3 of the drawing that the panel 12 will impose a uniform load L on the end 72a of tenon 72. Such will tend to cause rotation of support bar 70 about edge 104 of external shoulder 78.

Support bar 70 is drawn into channel 36 by stud 64 which restrains against outward movement of the support bar 70. It should be readily apparent that web 60 has a resulting force F1 on the head 82 adjacent external shoulder 78, and internal shoulder 58 has a resulting force F2 on external shoulder 80 of head 82 of support bar 70. Also, a resulting force F3 will result at the edge 104 of external shoulder 78 where rotation would occur. The resulting forces F1+F2+F3 will equal the loading force L caused by the weight of building panel 12, thus resulting in a stable support of the building panels 12 and 14.

Winds moving parallel to the building panels 12 and 14 will tend to create lateral forces. Abutments 90 and 92 are locked into engagement with internal shoulders 56 and 58 of channel 36 which restrains gasket 16 by locking extensions 106 against anchor lugs 74 and 76 preventing lateral movement of said gasket 16. Anchor lugs 74 and 76 provide a resulting force equal to that of any lateral forces created by winds and provides a restraint against lateral movement of gasket 16.

In addition filler strips 108 of relatively rigid material may be forced into grooves 110 formed in the outer surface of gasket 16 to create additional stiffening of gasket 16 against the exterior surface of building panel 12 to provide a better seal against the panel 12. Pockets 113 are formed on the inner surfaces of grooves 110 to provide hinges to allow the lips 114 of gasket 16 to be folded outwardly to permit insertion of panels 12 and 24 into slots 98 and 100.

A cavity 112 is formed in gasket 16 so as to allow a vacuum to be drawn inside of cavity 112 formed longitudinally of gasket 16 causing gasket 16 to deform in such a manner as to allow it to be easily assembled at the job site. Upon assembly the seal of cavity 112 is broken, allowing gasket 16 to return to its original shape.

Operation of the hereinbefore described invention is as follows:

Horizontal mullion 20 may be installed by placing angle 48 in channels 51 formed by shoulders 50 urging mullion 20 between vertical mullions 22, and fastening screws 52*a* and 52*b* to vertical mullion 22.

Gasket 16 is then deflected and tenon 72 of support bar 70 is aligned in groove 86 of gasket 16, and the gasket is then moved over anchor lugs 74 and 76 and deflected back to its normal shape. Studs 64 are then aligned with passages 62 drawing abutments 90 and 92 and external shoulders 78 and 80 into engagement with internal shoulders 56 and 58 of channel 36. Nut 84 is then threadedly engaged to stud 64 to urge and lock bar 70 into channel 36.

Panels 12 and 14 are then placed in the slots 98 and 100 of gasket 16 and final adjustment of the tension of gasket 16 is made by tightening a nut 84 to the proper torque. Adjustment of nut 84 on stud 64 may be achieved internally of the building as top 42 of horizontal mullion 20 may be removed and replaced after final adjustments have been made to horizontal support bar 70.

From the foregoing it should be readily apparent that the invention hereinbefore described accomplishes the object of the invention hereinbefore discussed.

It should be appreciated that other and further embodiments of the invention may be devised without departing from the basic concept thereof.

Having described my invention, I claim:

1. Apparatus to secure a curtain wall to a structural frame including: a horizontal mullion, said horizontal mullion having a channel formed therein; upper and lower shoulders formed horizontally along opposite sides of said channel; an elongated gasket support bar; a support tenon extending longitudinally of said support bar; anchor lugs extending longitudinally of the tenon on opposite sides thereof; an elongated resilient gasket, said gasket having a groove formed longitudinally in the inner face of said gasket of such shape and dimension as to receive said tenon and anchor lugs, said tenon and anchor lugs being disposed in and extending longitudinally of said groove, said anchor lugs being positioned adjacent said upper and lower shoulders, said gasket having upper and lower panel-receiving slots formed along opposite faces thereon, the upper slot being positioned above said tenon such that the tenon supports a panel disposed in the slot above the gasket, said gasket having abutment faces formed longitudinally of the gasket extending outwardly of the inner face of the gasket; and means to draw said support bar and abutment surfaces into said channel between said upper and lower shoulders to restrain said gasket about said tenon and anchor lugs and secure said support bar and gasket to said horizontal mullion.

2. The combination called for in claim 1, said horizontal mullion having a vertically disposed web, said web having spaced passages; and said means to draw said support bar and abutment surfaces into said channel between said upper and lower shoulders comprising: an elongated stud, said stud having first and second ends; means securing a first end of said stud to said elongated gasket support bar, the second end of said stud extending through said passage in said web; and means securing said stud relative to said web to lock said elongated gasket support bar in said channel.

3. The combination called for in claim 2, said elongated gasket support bar having a T-shaped groove formed therein; said means securing a first end of said stud to said elongated gasket support bar comprising: a head on said first end of said stud, said head being slideably disposed in said T-shaped groove.

4. The combination called for in claim 1, said horizontal mullion having a top; and means detachably securing said top to said horizontal mullion, said top being removeable to provide access to said means to draw said support bar and abutment surfaces into said channel.

5. The combination called for in claim 1, said elongated resilient gasket having filler strip receiving grooves formed in the outer surface; and an elongated filler strip which is harder than the gasket inserted in said filler strip receiving groove to reinforce the outer face of the gasket against distortion.

* * * * *